US006247832B1

(12) United States Patent
Neustadt

(10) Patent No.: US 6,247,832 B1
(45) Date of Patent: Jun. 19, 2001

(54) GLASS DOME HOLDER

(76) Inventor: Jerome Neustadt, 5 Holly Ave., Florida, NY (US) 10921

( * ) Notice: Subject to any disclaimer, the term of this patent is extended or adjusted under 35 U.S.C. 154(b) by 0 days.

(21) Appl. No.: 09/358,954

(22) Filed: Jul. 22, 1999

Related U.S. Application Data

(60) Provisional application No. 60/094,123, filed on Jul. 24, 1998.

(51) Int. Cl.[7] ..... F21V 17/00

(52) U.S. Cl. ..... 362/356; 362/358; 362/363; 362/374; 362/434; 362/453; 362/456; 362/147; 362/404; 362/396; 362/408; 362/435; 362/148; 362/368

(58) Field of Search ..... 362/358, 363, 362/374, 434, 453, 454, 147, 404, 408, 435, 148, 368, 396

(56) References Cited

U.S. PATENT DOCUMENTS 1,353,562 * 9/1920 Cahill ..... 362/356
1,630,004 * 5/1927 Guth ..... 362/147
4,031,382 * 6/1977 Laughter ..... 362/148
4,173,037 * 10/1979 Henderson, Jr. et al. ..... 362/287
4,403,277 * 9/1983 Eargle, Jr. et al. ..... 362/263
5,582,479 * 12/1996 Thomas et al. ..... 362/277
5,673,997 * 10/1997 Akiyama ..... 362/147
5,758,959 * 6/1998 Sleczkowski ..... 362/356
5,909,955 * 6/1999 Roorda ..... 362/368
5,961,205 * 10/1999 Lovell ..... 362/306
6,068,388 * 5/2000 Walker et al. ..... 362/304

* cited by examiner

*Primary Examiner*—Sandra O'Shea
*Assistant Examiner*—Anabel M Ton
(74) *Attorney, Agent, or Firm*—D. Peter Hochberg; Katherine R. Vieyr; William H. Holt

(57) ABSTRACT

A glass dome holder having an upper and a lower ring assembly for placing on the top and bottom of a glass dome. A plurality of spoke members connect the upper and lower ring assembly surrounding the glass dome and forming a unified structure. The upper ring assembly includes a J-bracket assembly including a J-bracket. A pair of connecting brackets are provided for connecting to a customer supplied U-bracket attached to a high bay unit. A socket and bracket assembly can be adjustably fixed to the connecting brackets. The hook portion of the J-bracket can be releasably fixed to the connecting bracket.

20 Claims, 4 Drawing Sheets

GLASS DOME HOLDER

CROSS REFERENCE TO RELATED APPLICATIONS

This application claims the benefit of United States Provisional Patent Application, Serial No. 60/094,123 filed Jul. 24, 1998, under Title 35 United States Code §119(e).

BACKGROUND OF THE INVENTION

1. Field of the Invention

The present invention relates generally to a holder for electric lights, and more particularly to a holder for holding large glass dome lights suspended from high ceilings.

2. Description of Prior Art

In most glass dome holders and supports, the glass dome and holder are connected to a high bay unit above an auditorium, gymnasium or other type of large room using glass dome lights. The dome and its support are fixed to the high bay unit. The electrician then installs the wiring necessary to run power from the bay unit to a socket and bulb assembly. The socket and bulb assembly is then fixed, so that the bulb is positioned within the glass dome.

The electrician's work is long and cumbersome because he must work around the large glass dome and its support structure when he installs the wiring, and the socket and bulb assembly. Additionally, the electrician must install the wiring high above the ground, and may decide that the location of the bulb inside the dome is not given the appropriate lighting. The electrician must then undo the wiring or adjust the wiring, so that the bulb is in the appropriate location. This trial and error method continues for every light in the room.

The present invention eliminates this problem by providing a large glass dome holder that can be installed quickly and easily after the wiring of the socket and bulb assembly has been put into place. The invention also allows for fixed adjustments of the location of the bulb within the glass dome.

SUMMARY OF THE INVENTION

In accordance with a preferred embodiment of the present invention, a glass dome holder is provided having a lower ring assembly for supporting the bottom flange of a glass dome, and an upper ring assembly for supporting the neck of the glass dome. The holder includes a plurality of elongated spoke members, each having a hooked end and a looped end. The bottom flange of the glass dome is disposed on the lower ring assembly. The upper ring assembly is located on the neck of the glass dome. The hooked end of the elongated wire members are each placed over the upper ring assembly. The body of the wire members run from neck of the glass dome to the bottom flange of the glass dome. The looped end of the wire members are each fixedly attached to the lower ring assembly by conventional means. The dome holder surrounds the glass dome.

A pair of J-bracket assemblies are fixed to the upper ring assembly and are positioned at opposite sides of the ring assembly. The J-bracket assemblies each include a lower portion that conforms to the circumference of the ring assembly, and an upper portion having right and left rod holding members. The middle of the upper portion is adapted to receive a rod holding member from a J-bracket. The J-bracket has a first end having a rod holding member and a second end that is shaped like a J or a hook. The rod holding member of the J-bracket is placed between right and left holding members of one of the J-bracket assemblies. A conventional rod or bolt is placed through the three rod holding members and locked in place. This fixes the J-bracket to the ring assembly.

A pair of connecting brackets are mounted to opposite ends of a customer supplied U-bracket that is mounted to a high bay unit. The connecting bracket is mounted via connection holes on top of the connecting bracket. The bracket may include a plurality of guide hole pairs and slots for holding a socket and bracket assembly in an adjustably fixed position. The connecting bracket includes a lower end with a right and left rod holder. A conventional rod or bolt extends through the right and left rod holder such that the middle portion of the rod or bolt is exposed between the right and left rod holder. The entire glass dome and holder structure can be easily mounted to the ceiling, after the electrical wiring has been completed, by placing the J or hooked end of the J-bracket over the exposed portion of the rod or bolt through the connecting bracket. The rod or bolt can then be tightened to cause the right and left rod holder to lock in the J or hooked end of the J-bracket. The J-bracket on the other side of the upper ring assembly is then locked into place causing the entire glass dome structure to be connected to the high bay unit, and to be suspended high above the ground or floor. In other words the connecting brackets, the J brackets and the J bracket assemblies are holding means for connecting the glass dome holder to the high bay unit.

An object of this invention is to provide a glass dome holder that can fix a glass dome to a support structure after the electrical wiring of the bulb socket has been completed.

Another object of this invention is to provide a glass dome holder that can be easily fixed and removed from the support structure.

An additional object of this invention is to provide a glass dome holder that provides easy adjustment of the placement of the bulb within the glass dome.

Another object of this invention is to provide an adjustment of the position of the bulb within the glass dome that can be performed before or after the placement of the glass dome.

A further object of this invention is to provide a glass dome holder that is low in cost, easy to manufacture, easy to assemble and easy to adjust.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 2:
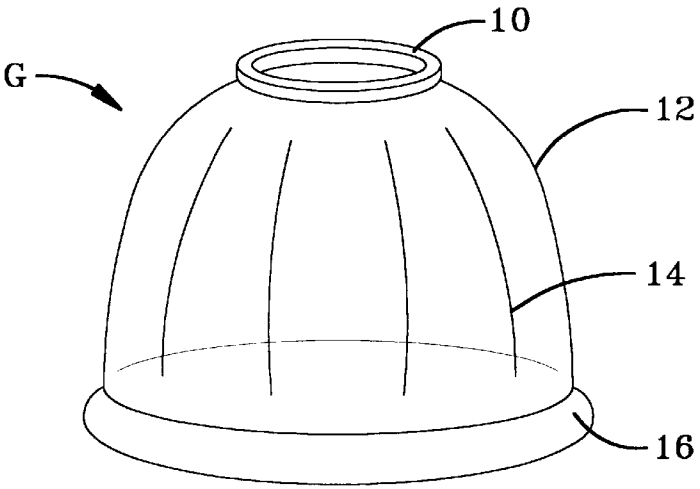
FIG. 2 is a front perspective view of a faceted glass dome.

Referring now to the drawings wherein the showings are for the purpose of illustrating the preferred embodiment of the invention only, and not for the purpose of limiting the same, FIG. 2 shows a typical glass dome G having a peripheral neck 10, a bottom peripheral flange 16, and an arched body portion 12 connecting neck 10 and flange 16. Body portion 10 may include light refracting facets 14. The glass dome G is to be mounted high above the ground to a high bay unit that provides the necessary electricity and electronics for lighting a light bulb suspended inside the glass dome.

Figure 1:
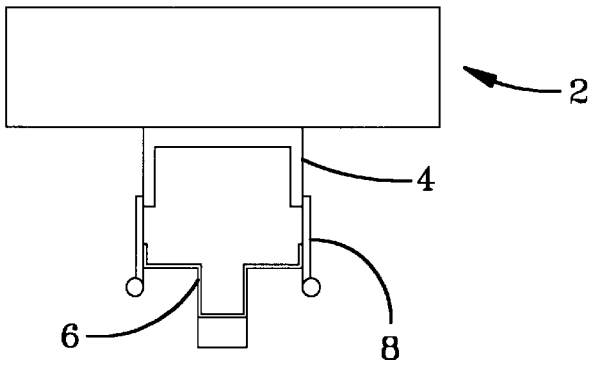
FIG. 1 is a front view of a pair of connecting brackets of a preferred embodiment of the invention connected to a conventional high bay unit.
Figure 3:
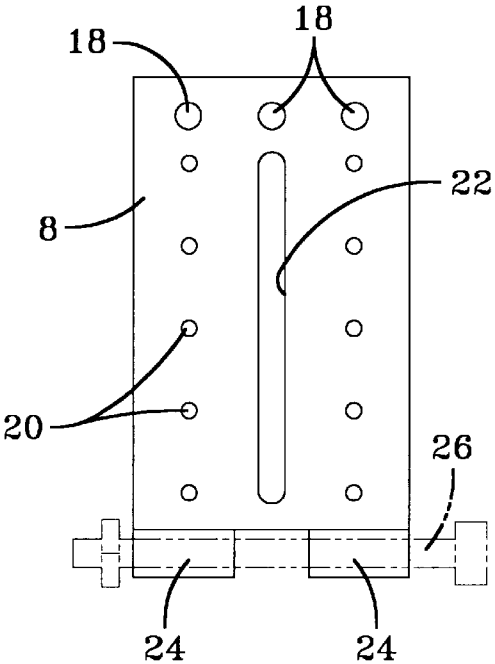
FIG. 3 is a front view of the connecting bracket of FIG. 1.

As can be seen in FIG. 1, a high bay unit 2 is provided with a customer provided U-bracket 4 mounted thereon. According to the preferred embodiment of the present invention, a pair of connecting brackets 8 are provided for mounting to the customer supplied U-bracket, for holding a bracket and socket assembly 6, and for holding the glass dome and the remaining portion of the glass dome holder in suspension above the ground. The connecting bracket is shown in FIG. 3, and includes three connecting holes 18 for mounting connection bracket 8 to customer supplied U-bracket 4. A plurality of socket guide holes 20 and a connection bracket slot 22 are provided for mounting socket and bracket assembly 6 in an adjustably fixed position. Socket and bracket assembly 6 is mounted by conventional methods to connecting bracket 8, such that a light bulb connected to the socket is positioned in the glass dome to give off optimal lighting. If socket and bracket assembly 6 is not positioned optimally, it can be easily removed and repositioned on connecting bracket 8, before or after the placement of glass dome G. Connecting bracketing has a lower end with right and left rod holders 24. A conventional rod or bolt 26 extends through rod holders 24, and is exposed between them. Once the optimal position is established, all other connection brackets and bracket and socket assemblies for other glass dome lights can be positioned in the same location.

Figure 4:
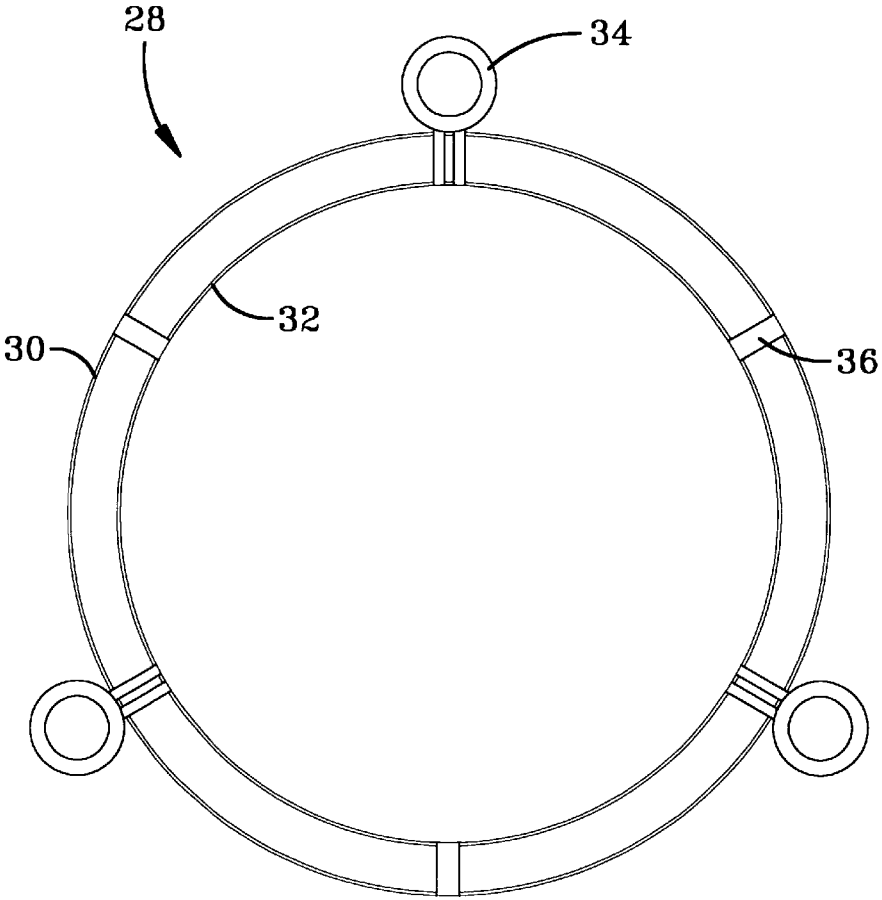
FIG. 4 is a top view of a lower ring assembly.

The remainder of the holder surrounds and supports glass dome G, and provides for easy connection and removal of the glass dome and the remainder of the glass holder to connecting brackets 8. FIG. 4 shows a lower ring assembly 28 used for supporting lower peripheral flange 16 of glass dome G. Ring assembly 28 includes an outer ring 30 and an inner ring 32, connected together by connecting bars 36 and bolt receiving assemblies 34. Inner ring 32 has a smaller diameter than outer ring 30, and is positioned lower than outer ring 30 when receiving glass dome flange 16. This allows glass dome flange 16 to rest on inner ring 32, while being surrounded and supported by outer ring 30.

Figure 5:
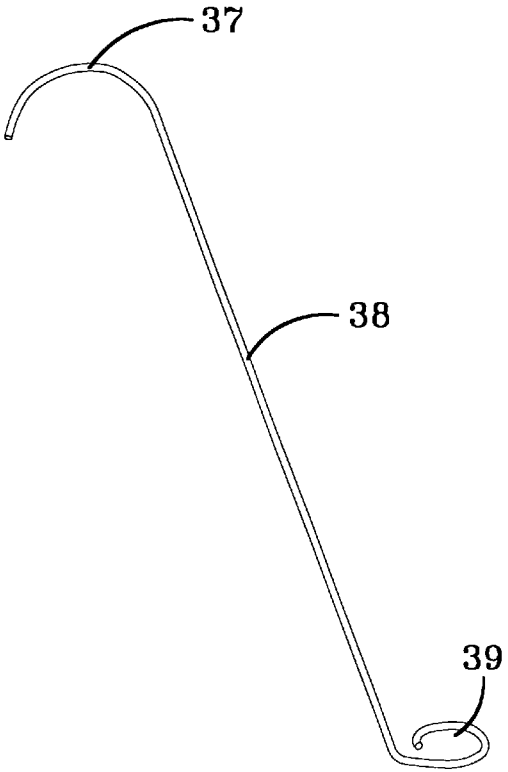
FIG. 5 is a side, perspective view of a spoke member.

A plurality of elongated members lock glass dome G in place and connect the upper and lower ring assemblies. FIG. 5 shows a wire spoke 38 having a hooked end 37 and a looped end 39. The wire spoke is used for locking in the glass dome G within the dome holder, and for connecting together the ring assemblies.

Figure 6:
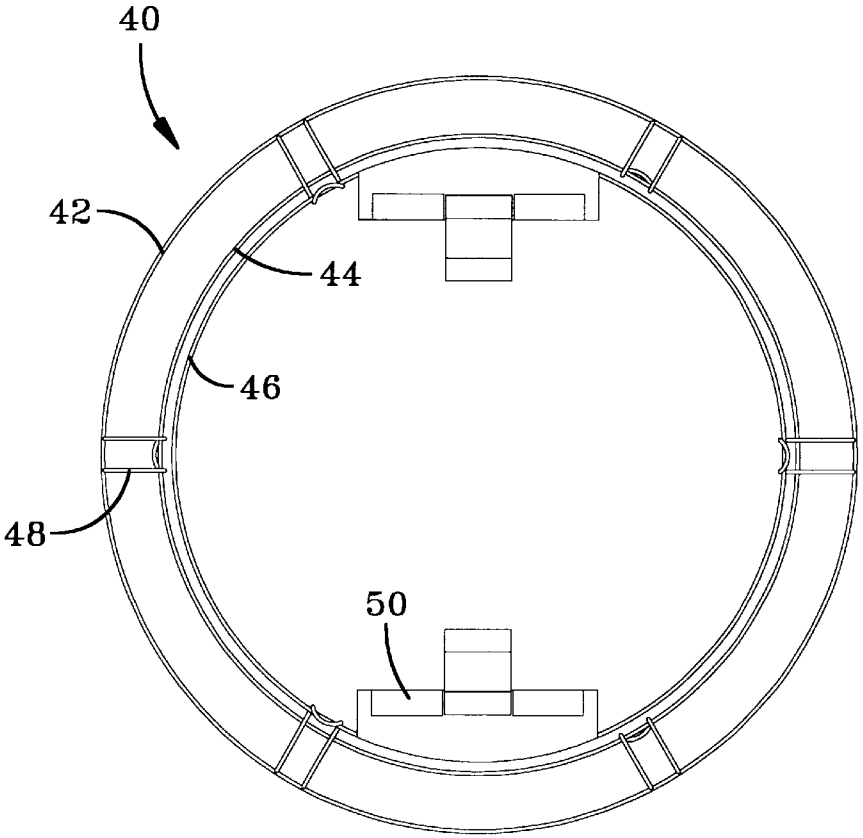
FIG. 6 is a top view of an upper ring assembly.

FIG. 6 shows an upper ring assembly 40 having an outer ring 42, and a pair of inner rings 44 and 46. Six wire loop connectors 48 connect outer ring 42 to inner rings 44 and 46. Three of wire loop connectors 48 have their ends bent upwardly, and three of the loop connectors 48 have their ends bent downwardly. This allows inner ring 44 to be positioned below outer ring 42, and inner ring 46 to be positioned above outer ring 40. Both inner rings 44 and 46 are approximately the same size, and are positioned such that inner ring 46 is directly above inner ring 44. A pair of J-bracket assemblies 50 are fixed to both inner rings 44 and 46, and positioned so that one of the J-bracket assemblies is directly on the opposite side of rings 44 and 46 of the other J-bracket assembly.

Figure 7:
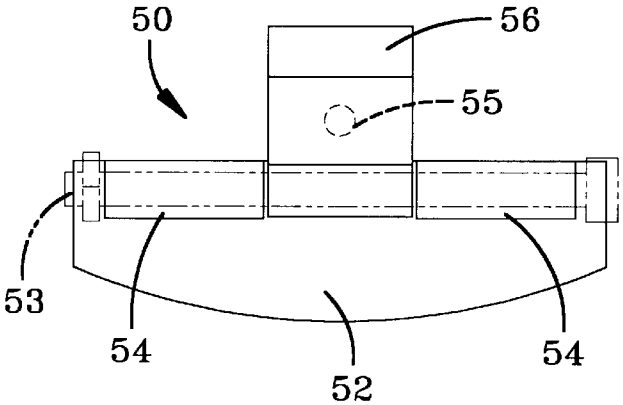
FIG. 7 is a front view of J-bracket assembly of FIG. 6.
Figure 8:
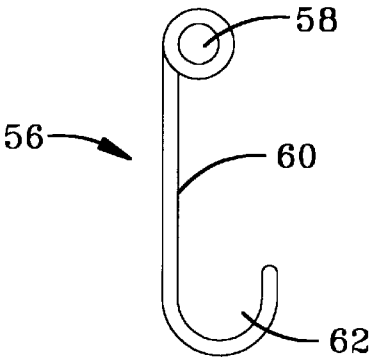
FIG. 8 is a side view of the J-bracket of FIG. 6 and FIG. 7.

As can be seen from FIGS. 7 and 8, J-bracket assembly 50 has a lower or body portion 52 and an upper or rod holding portion 54. Body portion 52 has a curvature similar to the curvature of inner rings 44 and 46 for easy fixed attachment to rings 44 and 46. Body portion 52 can be welded, soldered or attached by some other means to inner rings 44 and 46. The rod holding portion 54 consists of a left member and a right member leaving a gap therebetween. A J-bracket 56 can be placed in the gap between the left and right rod holding member of J-bracket assembly 50. J-bracket 56 includes a rod receiving portion 58, a bracket body 60 and a hook portion 62. A conventional bolt or rod 53 (shown in ghost lines) can be placed through both rod holders 54 on J-bracket assembly 50, and through rod receiving portion 58 on J-bracket 56, locking J-bracket 56 to upper ring assembly 40. A threaded hole 55 may be added for insertion of a small bolt, so when the unit is mounted on the ceiling, it could not be disassembled without removal of the screw. Hook portion 62 engages rod or bolt 26 of connecting bracket 8 to suspend the glass dome holder from connecting bracket 8.

Figure 9:
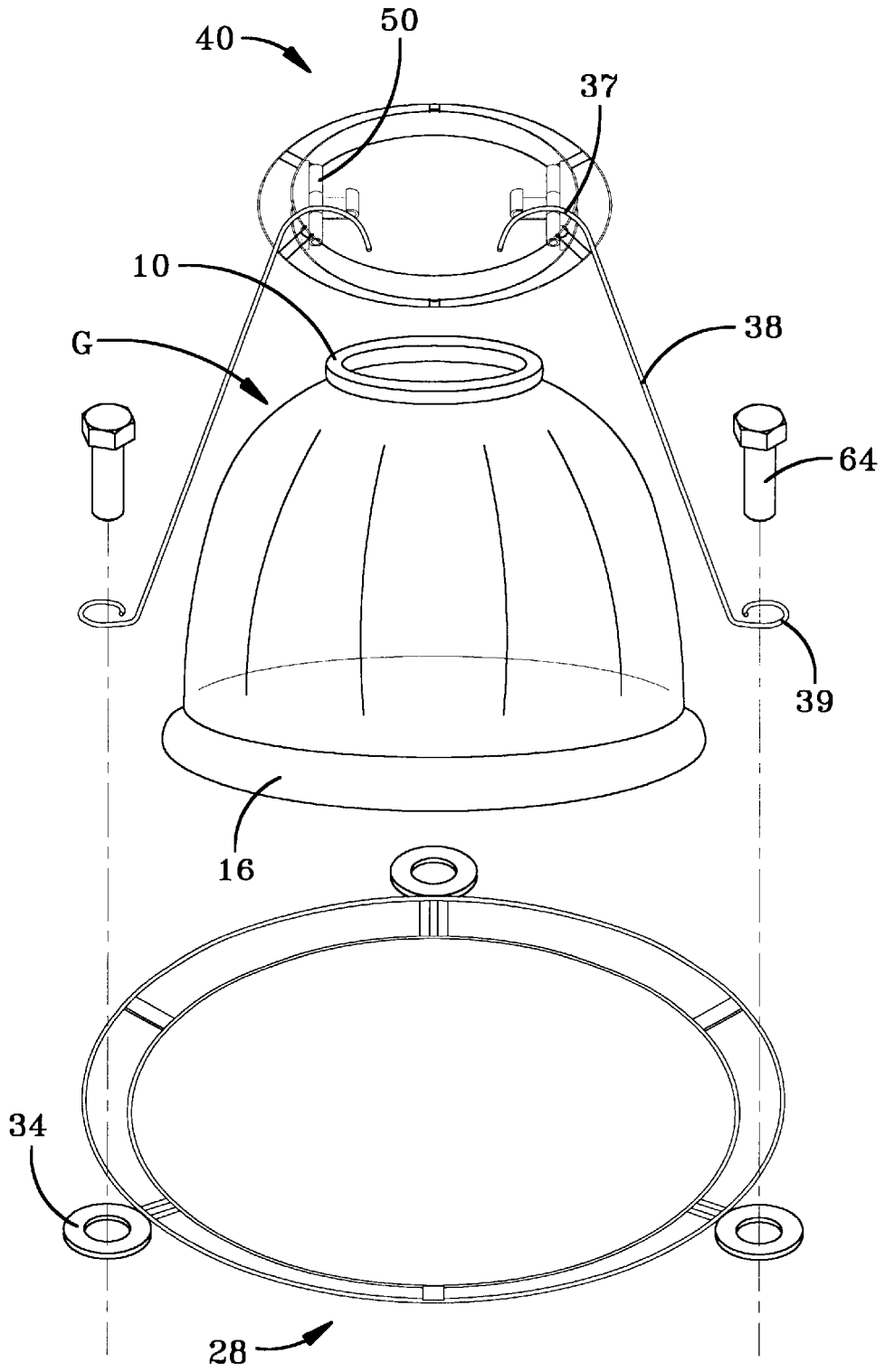
FIG. 9 is a front perspective view of the assembly in exploded form.

Referring to FIG. 9, the glass dome holder can be assembled by placing flange 16 of glass dome G over lower ring assembly 28. Upper ring assembly 40 is placed over neck 10 of glass dome G. Three wire spokes 38 (only two of which are shown) are positioned such that the hook portion 37 is placed over upper ring assembly 40, and the loop portion 39 is positioned over bolt receiving assembly 34. Conventional bolts 64 lock in loop portion 39 of wire spokes 38 to lower ring assembly 28, and thus lock in upper ring assembly 40. The glass dome holder encompasses the glass dome and creates a unified structure. Extended holding screws may be used in certain applications, when it is necessary to hold a piece of tempered glass, since this is required with certain lamps for protection against explosions. It should be appreciated that bolt receiving assemblies 34 could be located on upper ring assembly 40, as opposed to lower ring assembly 28. In this case hook portion 37 would be placed under lower ring assembly 28 and loop portion 39 would be locked in place at bolt receiving assemblies located on upper ring assembly 40.

Once the glass dome holder is formed into a unified structure, one of the hook portions 62 of J-bracket 56 can be looped over rod or bolt 26 held in rod holders 24 of connecting bracket 8. Rod or bolt 26 is tightened to lock in hook portion 62. The other J-bracket is then positioned and locked into place on the other connecting bracket in the same manner. Socket and bracket fixture 6 can be positioned up or down from its current position, on the connecting bracket with or without removing the glass dome or the dome holder.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar they come within the scope of the invention as claimed or the equivalents thereof.

What is claimed is:

1. A glass dome holder assembly for holding a glass dome to a high bay unit above an auditorium, gymnasium, or a large interior space with a high ceiling the glass dome having a peripheral neck, a bottom peripheral flange and an arched body portion connecting the peripheral neck to the bottom peripheral flange, said holder assembly comprising:

a glass dome holder including:

a lower ring assembly for supporting the peripheral bottom flange of the glass dome;

an upper ring assembly for supporting the peripheral neck of the glass dome;

a plurality of elongated members connecting the lower ring assembly and the upper ring assembly; and holding means for connecting said glass dome holder to said high bay unit.

2. The glass dome holder assembly of claim 1, wherein said holding means includes a first connection bracket means for holding a socket in an adjustably fixed position within the glass dome.

3. The glass dome holder assembly of claim 2, wherein said holding means further includes a second connection bracket means for releasably connecting said holder to said first connection means.

4. The glass dome holder assembly of claim 3, wherein said second connection bracket means is comprised of a pair of J-bracket assemblies fixed to the upper ring assembly and positioned at opposite sides of the ring assembly, each of said J-bracket assemblies having a lower portion that is fixed to and conforms to the circumference of said upper ring assembly and an upper portion including right and left rod holding members, and a J-bracket member with a first hooked end and a second end having a rod holding member adapted to fit between the right and left rod holding members, such that a conventional rod or bolt can be placed through the right and left holding members and the rod holding member of the J-bracket member holding and locking the rod holding member of the J-bracket member in a rotatably fixed position between the right and left holding members.

5. The glass dome holder assembly of claim 4, wherein said first connection means includes a pair of connecting ends being connectable to the high bay unit in a position oppositely facing one another, each connecting end including a lower end extending from said connecting end, each of said lower ends having a right and left rod holding member adapted to receive a conventional rod or bolt, such that a portion of the conventional rod or bolt between the right and left rod holder is exposed, so that said first hooked end of said J-bracket member can be placed over the exposed portion of the rod or bolt and locked into place by the tightening of the conventional rod or bolt.

6. The glass dome holder assembly of claim 2, wherein said first bracket connection means is adjustably fixed to a U-bracket connected to the high bay unit.

7. The glass dome holder assembly of claim 1, wherein said lower ring assembly includes an inner ring adapted to support the bottom surface of the bottom peripheral flange and an outer ring adapted to surround the outer surface of the bottom peripheral flange.

8. The glass dome holder assembly of claim 1, wherein each of said plurality of elongated members include a hooked end and a looped end, and said lower ring assembly includes a plurality of bolt receiving members around the perimeter of said lower ring assembly, said plurality of bolt receiving members equaling said plurality of said elongated members, wherein the bottom peripheral flange of the glass dome can be placed over the lower ring assembly, the upper ring can be placed over the peripheral neck of the glass dome, the hooked ends of said plurality of elongated members can be placed over the upper ring assembly at different locations around the circumference of the upper ring assembly and locked in place at its looped end by conventional nuts and bolts through said bolt receiving members, such that the glass dome and the holder form an integral unit.

9. A glass dome holder assembly for holding a glass dome to a high bay unit above an auditorium, gymnasium or a large interior space with a high ceiling, said glass dome holder assembly comprising:

a glass dome holder including:

a lower wire ring assembly for supporting the bottom of the glass dome;

an upper wire ring assembly for supporting the top of the glass dome; and a plurality of elongated wire spoke members connecting the lower ring assembly and the upper ring assembly, so that said holder and the glass dome can form an integral unit;

a first connection bracket means adjustably fixed to the high bay unit; and a second connection bracket means fixed to said upper wire ring assembly, said second connection bracket means being connectable to said first connection bracket means.

10. The glass dome holder assembly of claim 9, wherein said second connection bracket means is comprised of a pair of J-bracket assemblies fixed to the upper wire ring assembly and positioned at opposite sides of the upper wire ring assembly, each of said J-bracket assemblies having a lower portion that is fixed to and conforms to said upper wire ring assembly and an upper portion including right and left rod holding members.

11. The glass dome holder assembly of claim 10, and further including a J-bracket member with a first hooked end and a second end having a rod holding member adapted to fit between the right and left holding rod members of said second connection bracket means, such that a conventional rod or bolt can be placed through the right and left holding members and the rod holding member of the J-bracket member holding the rod holding member of the J-bracket member in a position between the right and left holding members.

12. The glass dome holder assembly of claim 11, wherein said first connection bracket means includes a pair of connecting ends being connectable to the high bay unit in a position oppositely facing one another, each connecting end including a lower end extending from said connecting end, each of said lower ends having a right and left rod holding member adapted to receive a conventional rod or bolt, such that a portion of the conventional rod or bolt between the right and left rod holder is exposed, so that said first hooked end of said J-bracket member can be placed over the exposed portion of the rod or bolt and locked into place by the tightening of the conventional rod or bolt.

13. The glass dome holder assembly of claim 9, wherein said first bracket connection means is adjustably fixed to a U-bracket connected to the high bay unit.

14. The glass dome holder assembly of claim 9, wherein each of said plurality of elongated wire spoke members include a hooked end and a looped end, and said lower wire ring assembly includes a plurality of bolt receiving members around the perimeter of said lower wire ring assembly, said plurality of bolt receiving members equaling said plurality of said elongated members, said bolt receiving members being adapted to receive a conventional bolt and nut and hold said looped end fixed to said bolt receiving members.

15. A glass dome holder assembly for holding a glass dome to a high bay unit above an auditorium, gymnasium or a large interior space with a high ceiling, the glass dome having a peripheral neck, a bottom peripheral flange and an arched body portion connecting the peripheral neck to the bottom peripheral flange, said holder assembly comprising:

a lower ring assembly for supporting the peripheral bottom peripheral flange of the glass dome;

an upper ring assembly for supporting the peripheral neck of the glass dome;

a plurality of elongated members connecting the lower ring assembly and the upper ring assembly;

a first connection bracket means for holding a socket in an adjustably fixed position within the glass dome; and a second connection bracket means for releasably connecting said glass dome holder assembly to said first connection bracket means.

16. The glass dome holder assembly of claim 15, wherein said second connection bracket means is comprised of a pair of J-bracket assemblies fixed to the upper ring assembly and positioned at opposite sides of the ring assembly, each of said J-bracket assemblies having a lower portion that is fixed to and conforms to the circumference of said upper ring assembly and an upper portion including right and left rod holding members, and a J-bracket member with a first hooked end and a second end having a rod holding member adapted to fit between the right and left rod holding members, such that a conventional rod or bolt can be placed through the right and left holding members and the rod holding member of the J-bracket member in a rotatably fixed position between the right and left holding members.

17. The glass dome holder assembly of claim 16, wherein said first connection bracket means includes a pair of connecting ends being connectable to the high bay unit in a position oppositely facing one another, each connecting end including a lower end extending from said connecting end, each of said lower ends having a right and left rod holding member adapted to receive a conventional rod or bolt, such that a portion of the conventional rod or bolt between the right and left rod holder is exposed, so that said first hooked end of said J-bracket member can be placed over the exposed portion of the rod or bolt and locked into place by the tightening of the conventional rod or bolt.

18. The glass dome holder assembly of claim 15, wherein said first bracket connection means is adjustably fixed to a U-bracket connected to the high bay unit.

19. The glass dome holder assembly of claim 15, wherein said lower ring assembly includes an inner ring adapted to support the bottom surface of the bottom peripheral flange and an outer ring adapted to surround the outer surface of the bottom peripheral flange.

20. The glass dome holder assembly of claim 15, wherein each of said plurality of elongated members includes a hooked end and a looped end, and said lower ring assembly includes a plurality of bolt receiving members around the perimeter of said lower ring assembly, said plurality of bolt receiving members equaling in number said plurality of said elongated members, wherein the bottom peripheral flange of the glass dome can be placed over the lower ring assembly, the upper ring can be placed over the peripheral neck of the glass dome, the hooked ends of said plurality of elongated members can be placed over the ring assembly at different locations around the circumference of the upper ring assembly and locked in place at its looped end by conventional nuts and bolts through said bolt receiving members such that the glass dome and the holder form an integral unit.

* * * * *